US005377996A

United States Patent [19]

Shure

[11] Patent Number: 5,377,996

[45] Date of Patent: Jan. 3, 1995

[54] ELECTRONIC PADDLE GAME DEVICE

[75] Inventor: Thomas S. Shure, Chicago, Ill.

[73] Assignee: Shure Products Inc., Chicago, Ill.

[21] Appl. No.: 64,959

[22] Filed: May 20, 1993

[51] Int. Cl.[6] ..... A63B 67/20

[52] U.S. Cl. ..... 273/330

[58] Field of Search ..... 273/329, 330, 331, 333, 273/319, 320, 321, 67 R, 334, 335, 413, 414

[56] References Cited

U.S. PATENT DOCUMENTS

| | | | |
|---|---|---|---|
| D. 170,758 | 11/1953 | Katherton | 273/329 X |
| 1,928,583 | 9/1933 | Young et al. | 273/330 |
| 1,947,859 | 2/1934 | Lathers | 273/329 |
| 2,047,744 | 7/1936 | Paul et al. | 273/330 |
| 2,159,817 | 5/1939 | Pierce | 273/330 X |
| 2,978,248 | 4/1961 | Harris | 273/330 |
| 3,148,883 | 9/1964 | Ruderian | 273/330 |
| 3,412,197 | 11/1968 | Weitzner | 84/1.03 |
| 3,961,792 | 6/1976 | Shankel | 273/67 R X |
| 4,199,141 | 4/1980 | Garcia | 273/376 X |
| 4,222,563 | 9/1980 | Heftler | 273/67 R |
| 4,270,751 | 6/1981 | Lowy | 273/381 X |
| 4,830,369 | 5/1989 | Poitras | 273/376 X |
| 5,249,810 | 10/1993 | Cazalet | 273/330 |

*Primary Examiner*—William H. Grieb
*Attorney, Agent, or Firm*—Welsh & Katz, Ltd.

[57] ABSTRACT

An electronic paddle game device includes a paddle having a ball striking surface and a hand-gripable handle. A plurality of impact sensors are positioned about the impact surface of the paddle for selective impacting by an object such as a ball struck by the impact surface. An electronic audible output signal generating circuit generates an audible output signal to a speaker when an impact sensor senses impact with an object. The paddle may also carry light emitting devices for visually indicating that an impact target has been struck. A ball is preferably tethered to the paddle. The paddle includes a handle that is adapted to store the ball during non-use. A counter and LCD display may be provided to generate and visually display a score based on impacts sensed by the impact sensors.

25 Claims, 6 Drawing Sheets

ELECTRONIC PADDLE GAME DEVICE

BACKGROUND OF THE INVENTION

The present invention relates generally to paddle game devices for striking objects such as resilient balls, and more particularly to a novel electronic paddle game device having an object striking surface defining one or more sensor areas for sensing impact of selected areas of the striking surface with an object, such as a tethered resilient ball, and providing an electronically generated response.

Over the years, great enjoyment has been derived from paddle games. Paddles for impacting an object in a game format, such as paddles for playing tennis, paddleball, or hitting a tethered ball, are well known. The paddles allow a player to strike a ball or other object with an impact or striking surface of the paddle so as to direct the struck object in a desired trajectory, or to hit the object consecutively for as long as possible, such as in the traditional game of hand-held paddleball played with a tethered or free resilient ball.

A variation in the traditional game of consecutively striking a tethered or free resilient ball with a paddle has added impact sensing mechanism to the paddle to sense contact of the ball with one or more target areas on the striking face of the paddle. For example, U.S. Pat. No. 1,928,583 discloses a paddle game wherein a ball is attached to a paddle through an elastic cord. A plunger extends through the paddle and is depressed when impacted by the ball to actuate a bell located on the rear face of the paddle. Thus, the bell is mechanically activated when the ball hits the plunger.

Other paddle game devices are known which also utilize mechanical linkage arrangements to cause audible sound to be mechanically generated in response to a tethered ball hitting a particular area of the striking face of the paddle. Further examples include U.S. Pat. No. 2,978,248 which discloses a paddle having a collapsible bulb responsive to being struck by an object to cause air to be expelled through an opening to blow a whistle mechanism located on the back of the paddle, and U.S. Pat. No. 2,159,817 which discloses a paddle having a compressible disk member on the ball impacting surface responsive to being hit by a ball to effect a clicking noise.

A drawback with known paddle game devices having mechanical linkage mechanisms to effect an audible response to the paddle impacting a ball or the like is that the mechanisms often rattle during use of the paddle and further add to the weight and complexity of the paddle. In addition, known paddle game devices which generate an audible response to impacting by a ball produce the same audible sound each time a target area on the face of the paddle is impacted.

Other paddle game devices are known which utilize electronic means to produce a response to hitting an object with the paddle. For example, U.S. Pat. No. 4,222,563 discloses a paddle having a multi-layer sensing mechanism in the form a network of open mesh strands and an elastically deflectable sheet which define an exterior surface on the paddle for hitting a ball. Contact of the exterior hitting surface with a ball, and the location of the hit or impact may be used to provide a signal for indicating a score. The score may be displayed on a liquid crystal display located in a handle. Such paddle devices are relatively complex and expensive to manufacture, do not provide an audible output in response to impacting a ball or the like, and do not provide selective target areas or zones on the striking face of the paddle.

SUMMARY OF THE INVENTION

One of the primary objects of the present invention is to provide an electronic paddle game device which electronically generates an audible signal when selective impact of the paddle with an object such as a ball is sensed.

Another object of the present invention to provide an electronic paddle game device which may be used as a game toy and wherein the device electronically generates different audible sounds in response to selective impacting with an object such as a ball or the like.

Another object of the present invention is to provide an electronic paddle game device which may generate and display a score based on imp;acts while also providing electronically generated audible signals based on impacts.

Still another object of the present invention is to provide a relatively low cost electronic paddle game device which provides a higher challenge to the players skill than required by prior paddle game devices.

In carrying out the present invention, an electronic paddle game device is provided which includes a paddle having a striking surface and a handle enabling the paddle to be manipulated by a user. An impact sensing mechanism, such as a plurality of depressible switches, is carried by the paddle and operatively positioned for sensing selective impact of the striking surface with an object such as a ball. An electronic circuit, coupled to the impact sensing mechanism, electronically generates an audible output signal when the impact sensing mechanism senses an impact. A sound transducing mechanism, such as a speaker, receives the audible output signal and outputs an audible sound. The electronic circuit may electronically generate a different audible output signal in response to impacting of different impact sensors such that a different audible output signal is generated each time a different impact sensor senses an impact.

The impact sensors are preferably positioned in a predetermined pattern to provide active areas and inactive areas on the striking surface such that impacts with the active areas are sensed by at least one of the sensors, and impacts with the inactive areas are not sensed by the impact sensors. Either of the active or inactive areas may be considered target areas.

The electronic paddle game device may also include light emitting devices, such as light emitting diodes, for visually indicating that an impact has been sensed. A resilient ball or similar object is preferably tethered to the paddle through an elastic string or cord-like member. The handle preferably has a storage area for storing the ball when not being used.

The electronic paddle game device may include a counter and visual display such as a liquid crystal display (LCD) to generate and visually display a score based on impacts sensed by the impact sensing mechanism. The electronic paddle game device is preferably made of plastic and includes an integrally formed paddle portion and ribbed handle with the ball storage area formed therein.

Further objects, advantages and features of the electronic paddle game device in accordance with the present invention will become apparent from the following detailed description taken in conjunction with the accompanying drawings wherein like reference numerals designate like elements throughout the several views.

DETAILED DESCRIPTION OF THE INVENTION

Figure 1:
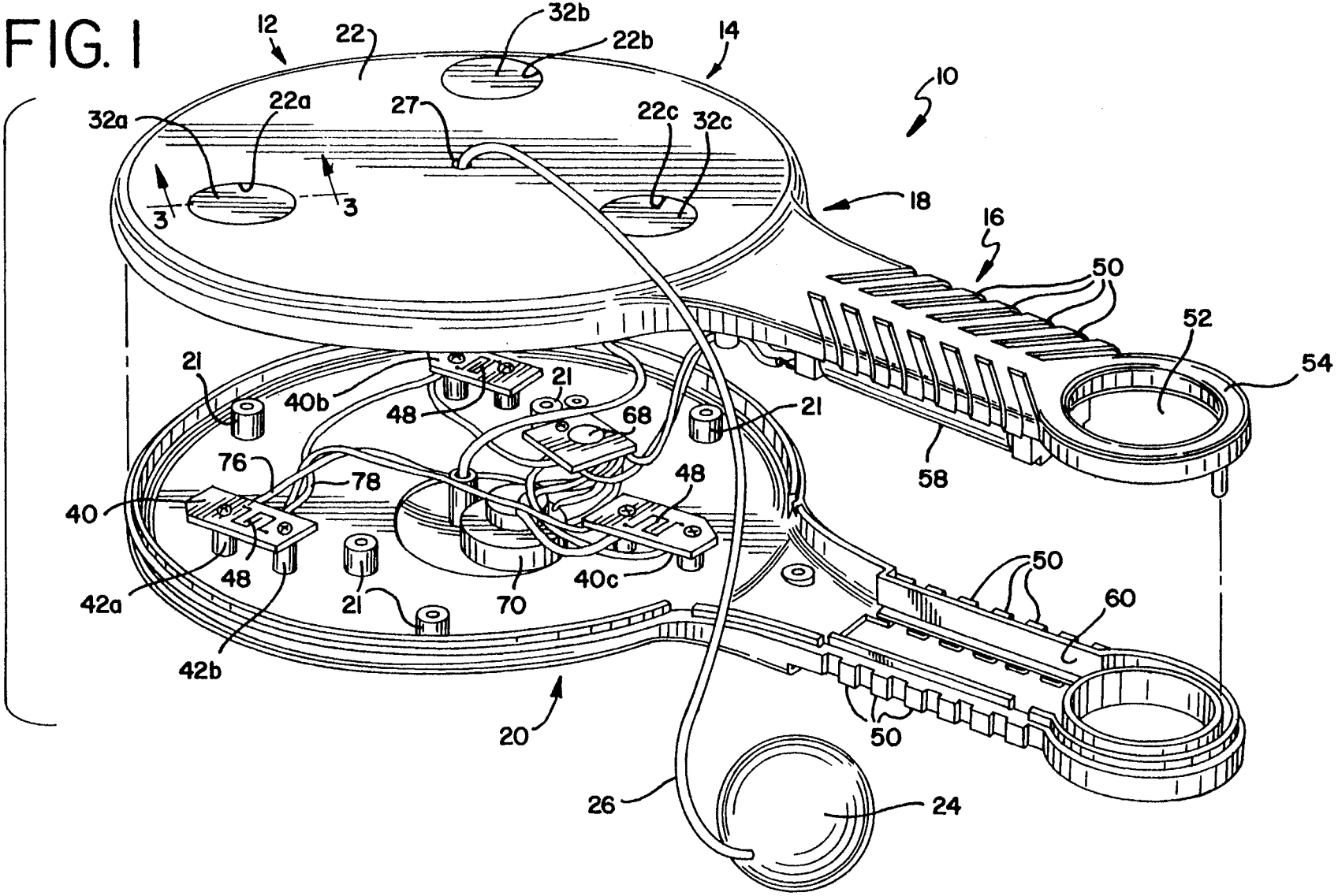
FIG. 1 is an exploded perspective view of one embodiment of an electronic paddle game device constructed in accordance with the present invention.

Referring now to the drawings, and in particular to FIG. 1, an electronic paddle game device constructed in accordance with one embodiment of the present invention is indicated generally at 10 and shown in exploded perspective. The paddle game device 10 includes a housing 12 defining a paddle portion 14 and a handle 16 formed integral with the paddle portion. The handle 16 allows a player to grasp and manipulate the paddle portion 14. Although the handle 16 is shown as protruding generally radially from the periphery of the paddle portion 14, it will be appreciated that the handle may take substantially any configuration which enables a user to hold and manipulate the paddle portion. Alternatively, the protruding handle 16 could be eliminated and a plurality finger receiving indentations formed about the periphery of the paddle portion (such as five for receiving one's fingers and thumb) to enable a user to place his/her finger tips into the indentations, with a hand strap being attached to the back of the paddle portion to retain the users hand in supporting relation with the paddle.

Figure 4:
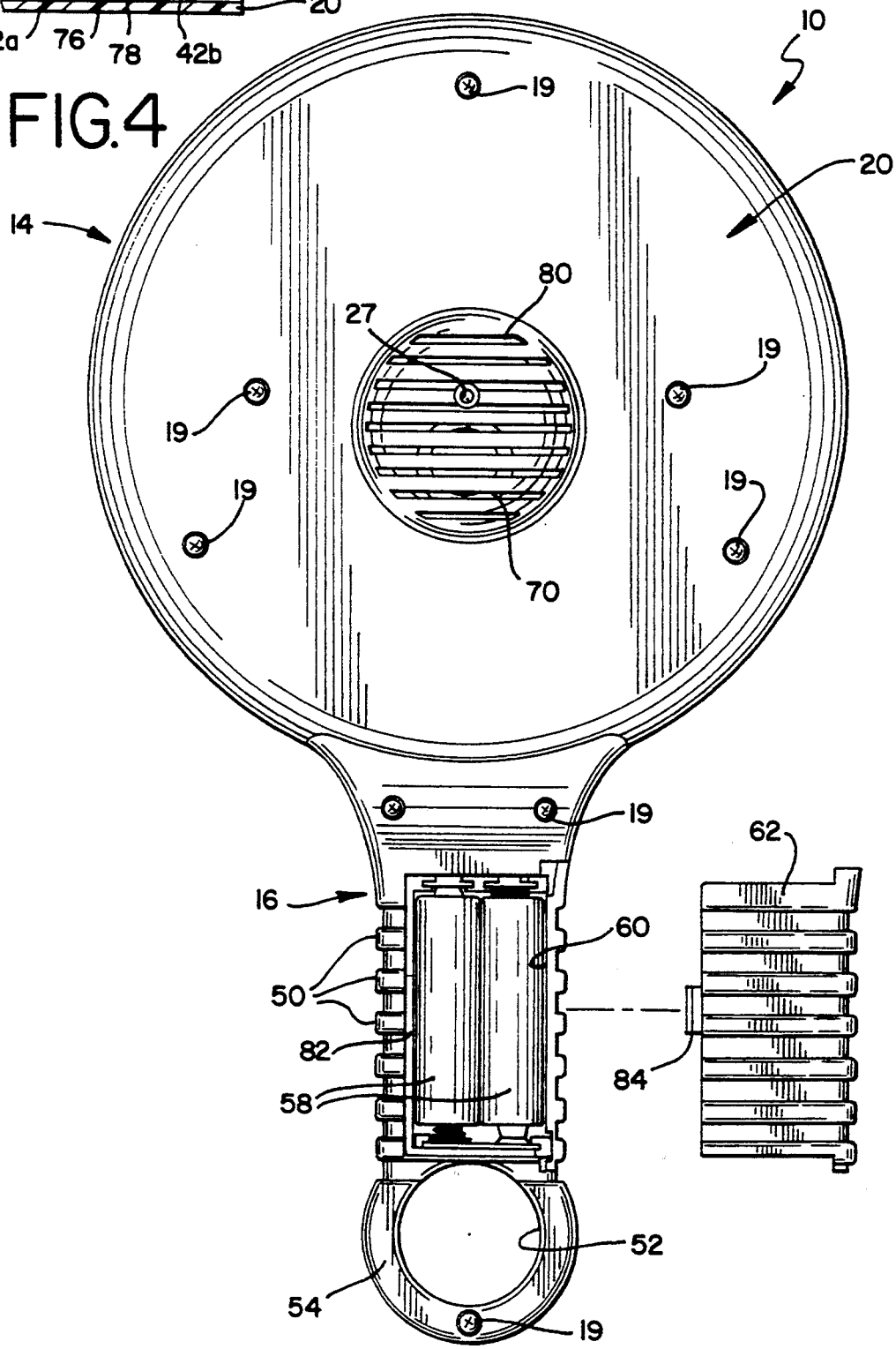
FIG. 4 is a rear elevational view of the electronic paddle game device of FIG. 1, but with the battery compartment cover removed.

In the illustrated embodiment, the housing 12 of the paddle game device 10 is formed from two generally similar shaped halves which are adapted for mating relation and define a front portion 18 and a rear portion 20. The front and rear portions 18 and 20 may be made from a suitable plastic using conventional molding techniques and have mutually cooperable bosses, such as indicated at 21 on the rear portion 20, to facilitate connection of the front portion 18 to the rear portion 20 by suitable self-tapping screws 19 (FIG. 4). The housing 12 defined by the assembled front and rear portions 18 and 20 is generally hollow to house the various operating components to be hereinafter described.

The paddle portion 12 includes a generally planar object striking surface or face 22 for striking or impacting an object such as a resilient ball 24. The handle portion 16 is preferably inclined downwardly from the plane of the striking face 22 at an angle of approximately about 5–10 degrees, but could be generally coplanar with the paddle portion 14. The ball 24 may be tethered to the paddle 12 by an elastic cord 26. In the illustrated embodiment, an aperture 27 is formed centrally through the paddle portion 12 to receive the cord 26. The aperture 27 is preferably formed through a boss 28 formed centrally in the rear paddle portion 20.

The striking surface 22 includes impact sensor means in the form of a plurality of circular impact sensors **32*a*–32*c* which cooperate with the striking surface for sensing impact of selected areas of the striking surface 22 with an object. The impact sensors 32*a*–32*c* form part of the striking surface 22 and have outer exposed surfaces which are substantially coplanar with the remainder of the striking surface. Alternatively, the impact sensors 32*a*–32*c* could be supported below the striking surface 22 in underlying relation to resilient or elastic areas of the striking surface 22 which are depressed upon impact by the ball 26** so that the sensors are activated.

Figure 3:
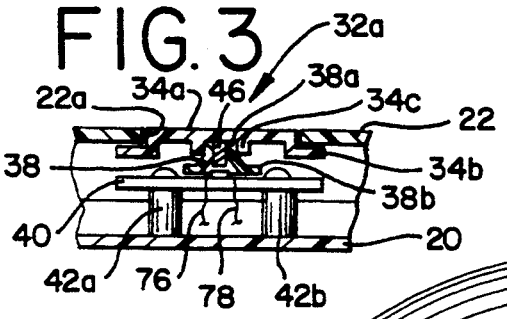
FIG. 3 is a fragmentary cross-sectional view taken generally along line 3—3 of FIG. 1 showing an embodiment of an impact sensor.

Referring to FIG. 3, the impact sensor **32*a* is representative of the impact sensors 32*a*–*c* and includes a cap 34 having a circular upper impact portion 34*a* and a stepped-down circumferential rim 34*b*. The circular impact portion 34*a* is biased into a circular opening 22*a* in the striking surface 22 by a cone-shaped resilient rubber spring member 38. The spring member 38 has an upper neck end 38*a* secured internally of a circular recess 34*c* formed on the lower surface of the cap impact portion 34*a*. A lower annular rim 38*b* on the spring member 38 acts against a circuit board 40 supported on bosses 42*a* and 42*b* formed internally of the rear paddle portion 20 so that spring member 38 biases the impact portion 34*a* of impact sensor 32*c* into the opening 22*a* with the rim 34*b* acting against the lower surface of the striking face 22**.

An electrically conductive contact 46 is secured within the upper neck end **38*a* of the resilient spring member 38 so as to move with the cap 34. The contact 46 has a lower contact end spaced from the circuit board 40 when the cap is in its upper non-depressed position as shown in FIG. 3. The circuit board 40 has electrical traces 48 on its upper surface defined by a pattern of exposed copper. When the cap 34 of the impact sensor 32*a* is depressed by impacting with the ball 26 or other similar object, the contact 46 engages the circuit board 40 and shorts two traces together. The impact sensors 32*b* and 32*c* are of similar construction and have similar corresponding circuit boards associated therewith, such as indicated at 40*b* and 40*c*** in FIG. 1.

The impact sensors **32*a*–32*c* serve as switches to indicate that an impact sensor area on the striking face 22 has impacted with the ball 24. The impact sensors 32*a*–32*c*** depress upon impact and generate a sensing signal that is received by an integrated circuit as will be described with reference to FIG. 2. It will be recognized that any suitable impact sensing mechanism may be used, including other types of depressible electronic pressure sensors or non-depressible sensors that respond to an impact.

The handle 16 preferably includes a plurality of integrally formed ribs 50 which are raised and inclined to the longitudinal axis of the handle to facilitate gripping by a player. The handle 16 includes a through-hole 52 at its outer end defined internally of an annular rim 54 formed on the end of the handle. The through-hole 52 and annular rim 54 provide a means to receive and store the ball 24 when the ball 24 is not being used. The outer diameter of the annular rim 54 is greater than the transverse width of the grip portion of the handle 16 to inhibit the handle from slipping out of a player's hand during play. The handle 16 is hollow and is adapted to house a power source, such as a plurality of batteries 58. An access opening 60 is provided in the handle, such as in the rear portion of the handle, for insertion and removal of a pair of batteries. A cover 62 (FIG. 4) is adapted for releasable mounting on the handle to overlie the batteries.

Figure 2:
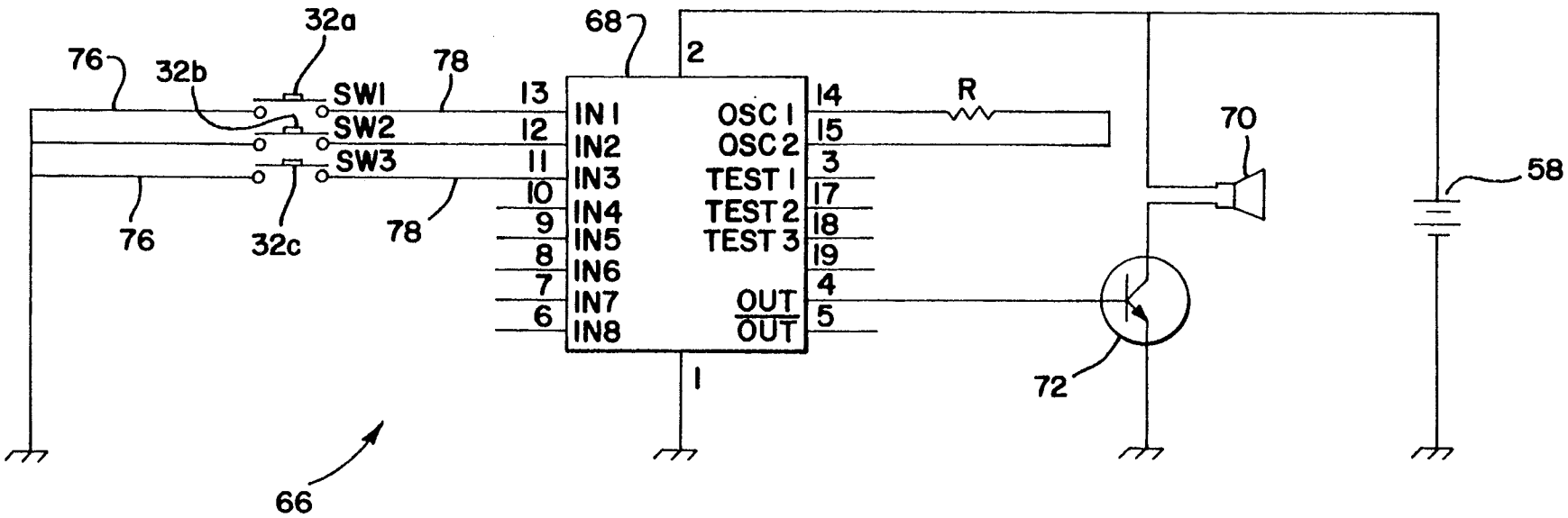
FIG. 2 is a schematic electrical circuit diagram generally depicting one embodiment of a circuit for use in the paddle game device of FIG. 1 to generate an audible output signal in response to an impact sensed by an impact sensor carried by the paddle.

Referring to FIGS. 1 and 2, the electronic paddle game device 10 includes electronic circuit means in the form of an electronic circuit 66 for electronically generating an audible sound when the impact sensor means responds to an impact such as when one of the impact sensors 32*a*–32*c* senses an impact by an object. The circuit 66 includes an integrated circuit 68 having inputs (IN1–IN3) coupled to each of the impact sensors 32*a*–32*c*. The impact sensors 32*a*–32*c* generate a sensing input signal to the integrated circuit 68. The sensing input signal is generated when an impact sensor is depressed and shorts an input (IN1–IN3) to ground. The integrated circuit 68 then outputs an audible output signal to a sound transducer 70, such as a speaker, in response to the sensing signal. The speaker 70 thus emits an audible sound responsive to an impact sensor sensing an impact between a selected area of the paddle striking face 22 and an object, such as the ball 24.

The integrated circuit 68 generates a different audible output signal in response to sensing of an impact by each different impact sensor 32*a*–*c*. For example, a different audible output signal is generated when impact sensor 32*a* is depressed, as compared to when impact sensor 32*b* is depressed. Therefore, each impact sensor causes a different corresponding output signal to be generated. The input sensors 32*a*–32*c* may be defined as target areas on the striking face 22 of the paddle 14 which, when struck by a ball or other object, cause a different audible signal to be output by the speaker 70. The power source 58 provides the requisite power to the integrated circuit 68.

The integrated circuit 68 may comprise any device for electronically generating audible output signals, such as a VITELIC Model No. VM99 manufactured by VITELIC Ltd., Hong Kong. The integrated circuit 68 includes an on-board oscillator having its frequency determined in part by an external resistor R. The audible output signal is generated at an output pin (OUT) of the integrated circuit and couples to an amplifier 72 such as an NPN transistor. The emitter of transistor 72 is coupled to ground, its collector is coupled to a terminal of the speaker 70, and its base is coupled to receive the audible output signal from the integrated circuit 68.

The impact sensors 32*a*–32*c* are preferably selectively positioned in a predetermined pattern on the paddle striking face 22 so as to establish active areas which generate an audible or score signal when impacted by the ball 24, and leaving the remainder of the striking face as one or more inactive areas which do not generate an audible or score signal when impacted by the ball. By providing both active an inactive impact response areas on the paddle striking face 22, a number of different game formats may be developed for the paddle game device 10 as hereinafter described.

In one mode of operation or play of the paddle game device 10, a player may grasp the handle 16 and manipulate the paddle portion 14 in an attempt to cause the ball 24 to impact an impact sensor 32*a*–32*c* on each impact of the ball with the striking face 22 of the paddle. The circuit 66 will cause an audible sound to be output from the sound transducer 70 in response to each impact sensed by one of the sensors. When the object of play is to achieve audible sound impact responses, the sensors 32*a*–32*c* may be considered target areas on the face of the paddle. In an alternative mode of play, the player may attempt to avoid hitting the impact sensors 32*a*–32*c* with the ball and instead attempt to strike the ball with an inactive area of the paddle. In this game format, the inactive area of the paddle face 22 becomes the target area and the player might continue to hit the ball with the paddle until an impact sensor is impacted, thereby indicating that an area outside the desired target area has been hit. It will be appreciated that while the embodiment illustrated in FIGS. 1–4 utilizes three impact sensors 32*a*–*c* generally equidistantly circumferentially spaced about a common circle concentric with the center axis of the circular paddle 14, a greater or smaller number of impact sensors, i.e. active target areas, could be provided in a uniform or nonuniform pattern on the face of the paddle, and that either the inactive or active areas may be considered as target areas.

As aforedescribed, when the cap 34 of an impact sensor 32*a*–*c* is depressed by impact with the ball 24, the corresponding contact 46 makes electrical contact with traces 48 on the corresponding circuit board 40 to complete a circuit which generates a sensing signal to the integrated circuit 68. A pair of electrical leads, such as indicated at 76 and 78 in FIG. 1 for circuit board 40, are short circuited together to indicate that an impact has been sensed.

As illustrated in FIG. 4, the rear portion 20 of the paddle housing 12 may have an integrally formed louver or open slot area 80 to enable better sound emission from the sound transducing device 70. The handle 16 has a recess 82 formed to releasably receive a retaining tab 84 on the battery cavity cover 62.

Figure 5:
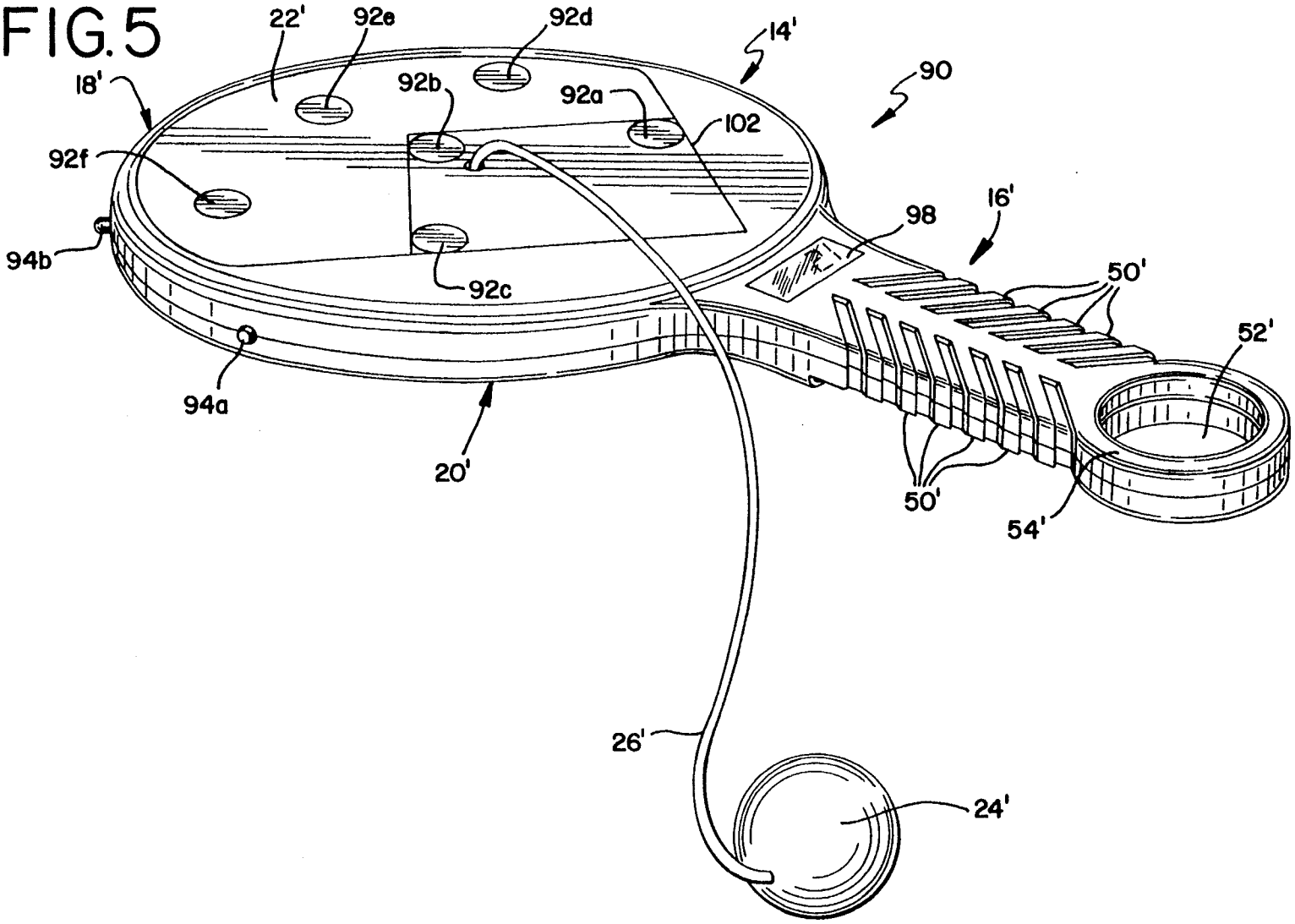
FIG. 5 is an exploded perspective view of an electronic paddle game device in accordance with another embodiment of the invention.
Figure 6:
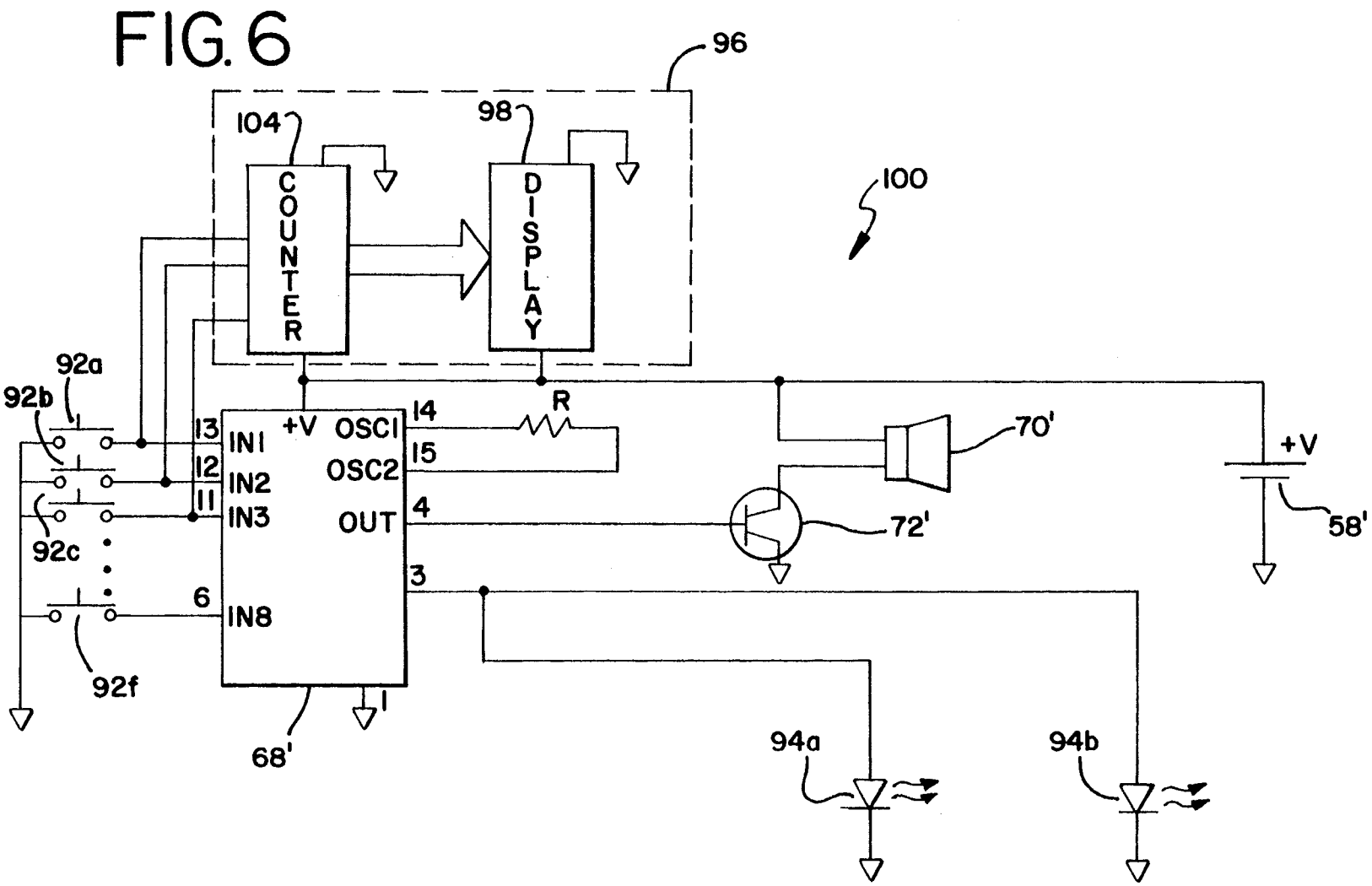
FIG. 6 is a schematic circuit diagram generally depicting an electronic circuit for use with the paddle game device of FIG. 5 to generate audible signal outputs and display a numerical score.

FIGS. 5 and 6 illustrate an alternative embodiment of an electronic paddle game device, indicated generally at 90, in accordance with the invention which is similar to the paddle game device 10 and wherein similar elements are indicated by like but primed reference numbers. The game device 90 includes a different arrangement of impact sensors 92*a*–92*f*, light emitting means including a plurality of light emitting devices, two of which are indicated at 94*a* and 94*b*, and score generating display circuitry 96. The paddle game device 90 is operative to generate audible sounds, flashing light signals and a visually displayed score in response to impact of the impact sensors 92*a*–*f*, which are carried on a striking surface 22' on a paddle portion 14', with a tethered ball 24' similar to the paddle game 10.

The light emitting devices 94*a* and 94*b* visually indicate that an impact has been sensed by one of the impact sensors 92*a*–92*f*. The score generating and display circuitry 96 electronically generates and visually displays a score based on impacts sensed by the impact sensors 92*a*–92*f*. The score is displayed on an LCD display 98 preferably formed adjacent the connection of the handle portion 16' to paddle portion 14'. The light emitting devices 94*a* and 94*b* may comprise light emitting diodes (LEDs).

FIG. 6 schematically illustrates an electronic circuit 100 for use with the paddle game device 90 and which is similar to the aforedescribed circuit 42. Circuit 100 includes the additional score generating and display feature and light emitting devices 94*a* and 94*b* connected to the integrated circuit 68' as shown. The impact sensors 92*a–f* are located on and form a part of the striking surface 22' of the paddle 14'. The impact sensors 92*a–92f* may comprise impact sensors similar in construction to the aforedescribed impact sensors 32*a–c*.

Indicia in the form of a desired imaginary game format, such as an imaginary baseball diamond format 102, may be formed on the striking surface 22' of the paddle 14' as by distinctive coloring or a decal or the like. Each of the impact sensors 92*a–92f* may serve as a target area which the player attempts to hit with the ball 24'. The score generating and display circuit 96 counts the number of impacts sensed by the sensors 92*a–92f* by means of a digital counting device 104 and displays the count on the LCD display 98. The digital counting device 104 serves as the mechanism to keep track of the number of impacts sensed by the sensors 92*a–92f* and outputs the number to the display 98 in a known manner. Any suitable counter and display may be used.

The light emitting devices 94*a–94b* are coupled to an output pin of the integrated circuit 68' such that a sensing input signal on the input lines (IN1–IN8) causes a pulsing signal to activate the light emitting devices 94*a–94b*. Hence, the light emitting devices 94*a–94b* flash each time an impact sensor senses an impact.

The electronic paddle game device 90 may thus electronically generate and visually display a score based on impacts sensed by the impact sensors 92*a–92f*. The score may be based upon the number of impacts sensed by the impact sensing sensors 92*a–92f* or may be based upon the location of a particular impact sensor. For example, a higher count could be generated if a player hits sensor 92*c* as compared to hitting sensor 92*a* since the location corresponding to an imaginary first base (sensor 92*a*) in the baseball diamond game format 102 might be established to result in a lower score than hitting a third base impact sensor 92*c*. Since the player attempts to score runs as in baseball, a higher score would result if a "triple" is sensed as compared to a "single".

In an alternative embodiment, the impact sensing mechanism may include a plurality of individual impact sensors in the form of depressible switching devices which are located under a single depressible or flexible cap having an exposed impact surface substantially coplanar with the remaining surface area of the paddle striking face. The impact sensing mechanism and associated cap may be located in the center of the striking surface 22 of the paddle portion 14 and may define a circular target area to be hit by the ball 24. The circular central depressible cap or target area may have a diameter greater than the diameter of the impact sensors 32*a–c*.

Figure 7:
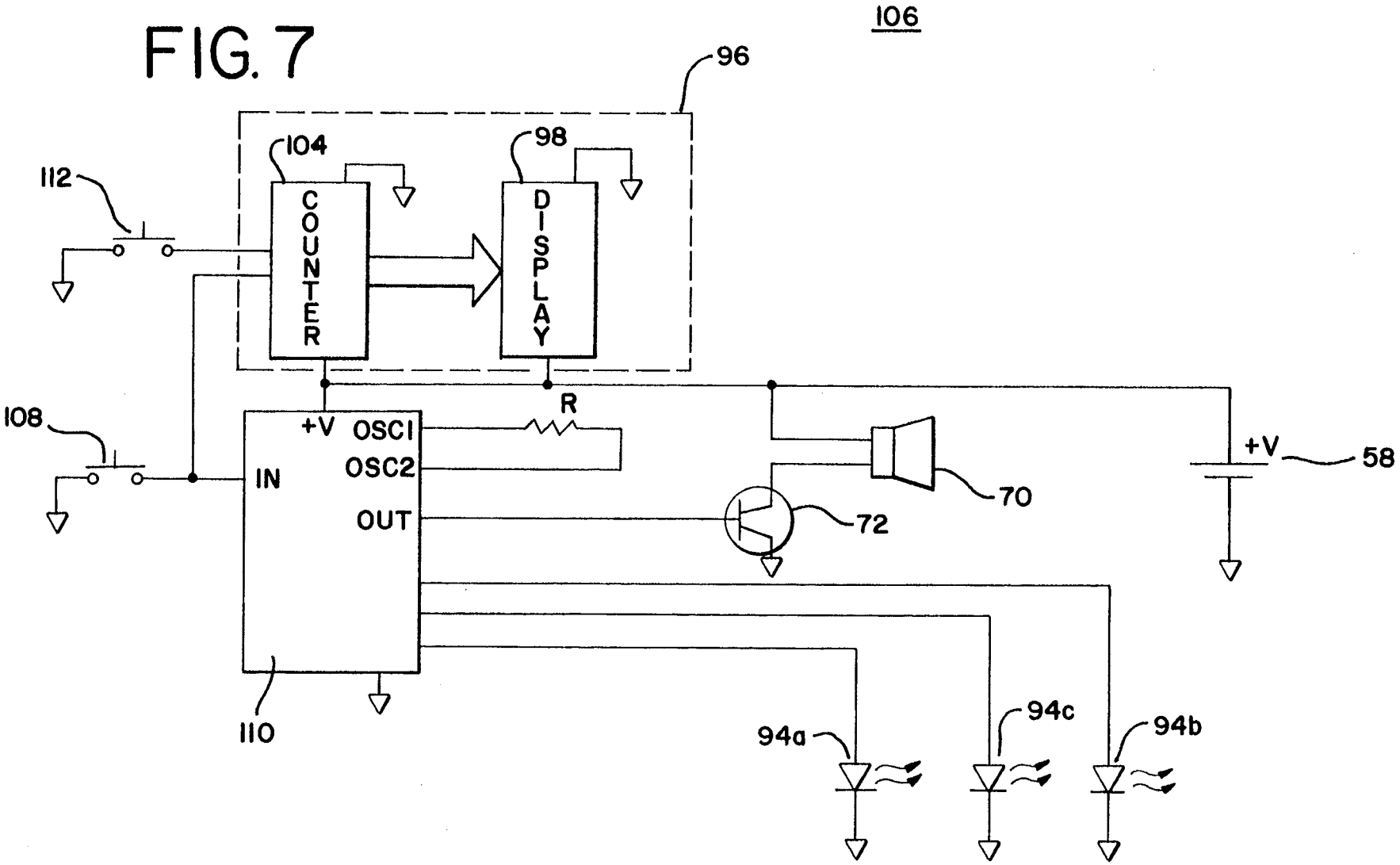
FIG. 7 is a schematic circuit diagram generally depicting another embodiment of an electronic circuit for use with a paddle game in accordance with the invention.

FIG. 7 illustrates a circuit 106 wherein one impact sensor 108 facilitates the generation of multiple sounds. A sound generating IC 110 such as a VITELIC model VM89, sequentially outputs a plurality of different sounds in response to sequential activation of the impact sensor 108. Hence, a different audible output (one of eight different sounds) is generated for each activation of the impact sensor so that a plurality of different audible output signals may be generated by impacting a single active target area on the paddle striking face.

LED's 94*a–94c* receive a pulsed signal from the sound generating IC 110 when the impact sensor 108 is depressed to cause the LED's to flash. A counter and display 96 such as an UMC model UM 3220 4 digit-multiplexed LCD step counter, generates a score based on the number of times that the impact sensor 108 is impacted. A reset button 112 located on the paddle allows a user to reset the counter.

It will be recognized that although a single integrated circuit has been employed to detect sensing signals from impact sensors, electronically generate audible signals in response to the impact sensing signals, and activate light emitting devices, any suitable combination of discrete circuits or other circuitry may be utilized. For example, the functions of the integrated circuit may be carried out by a suitable microprocessor or microcomputer arrangement.

While specific embodiments of an electronic paddle game device in accordance with the present invention have been illustrated and described, it will be understood to those skilled in art that changes and modifications may be made therein without departing from the invention in its broader aspects. It is therefore intended to cover by the following claims all modifications, variations, or equivalents that fall within the spirit and scope of the present invention.

What is claimed is:

1. An electronic paddle game device comprising, in combination, a hand-holdable paddle having a generally circular paddle portion defining a pair of opposite outwardly facing substantially rigid striking surfaces, and having a handle portion fixed to said paddle portion for enabling said paddle to be manipulated to impact an object with said striking surface;

impact sensing means cooperative with one or more discrete areas on at least one of said striking surfaces less than the full area thereof for sensing an impact between said discrete areas of said striking surface and said object;

electronic means carried within said paddle and coupled to said impact sensing means for electronically generating an audible output signal when said impact sensing means senses an impact with a discrete area by said object; and sound transducing means responsive to said audible output signal for outputting an audible sound.

2. An electronic paddle game device as defined in claim 1 wherein said impact sensing means comprises switch means adapted to generate a sensing signal.

3. An electronic paddle game device as defined in claim 2 wherein said electronic signal generating means outputs said audible output signal to said sound transducing means in response to said sensing signal.

4. An electronic paddle game device as defined in claim 1 further comprising a ball tethered to the paddle for impacting with said striking surface.

5. An electronic paddle game device as defined in claim 1 further comprising light means for visually indicating that a discrete area of said impact sensing means has sensed that said striking surface has been impacted by said object.

6. An electronic paddle game device as defined in claim 5 wherein said light means is adapted to flash to indicate that said impact sensing means has sensed that a discrete area of said striking face has been impacted.

7. An electronic paddle game device as defined in claim 1 wherein said impact sensing means defines a discrete target at each of said discrete areas for impacting by an object, each of said discrete targets having an impact surface substantially coplanar with the remainder of the striking surface.

8. An electronic paddle game device as defined in claim 1 wherein said striking surface includes areas which when impacted by said object are not sensed by said impact sensing means.

9. An electronic paddle game device as defined in claim 1 wherein said impact sensing means includes a plurality of impact sensors positioned in a predetermined pattern on said striking surface to provide active impact areas and inactive impact areas on said striking surface such that impact of an object with one of said active impact areas is sensed by at least one of said impact sensors, and impact of said object with said inactive impact areas is not sensed by said impact sensors.

10. An electronic paddle game device comprising, in combination:

a hand-holdable paddle having a paddle portion defining at least one rigid generally planar striking surface, and handle means fixed to said paddle portion for enabling said paddle to be manipulated to impact an object with said striking surface;

impact sensing means including a plurality of impact sensors cooperative with said striking surface for sensing an impact between selective discrete surface areas of said striking surface and said object;

means operatively coupled to said plurality of impact sensors for electronically generating a different audible output signal for each different impact sensor; and sound transducing means responsive to each of said different audible output signals for outputting a corresponding different audible sound.

11. The electronic paddle game device of claim 10 wherein each of said plurality of impact sensors includes a discrete target surface carried by said striking surface in substantially coplanar relation with the remainder of said striking surface, and switch means responsive to impacting of a target surface by an object to cause a sensing signal to be generated.

12. The electronic paddle game device of claim 11 wherein said electronic signal generating means outputs at least one of the different audible output signals to said sound transducing means in response to said sensing signal.

13. The electronic paddle game device of claim 10 further comprising a ball tethered to said paddle for impacting said striking surface.

14. The electronic paddle game device of claim 10 further comprising light means for visually indicating that an impact has been sensed by at least one of the selective surface areas.

15. The electronic paddle device of claim 14 wherein said light means is adapted to flash to indicate that impact has been sensed by one of said impact sensors.

16. The electronic paddle game device of claim 10 further comprising means operatively coupled to said sensing means for electronically generating and visually displaying a score based on impacts sensed by said impact sensing means.

17. An electronic paddle game device comprising, in combination:

a hand-holdable paddle having a generally circular paddle portion defining a substantially rigid striking surface, and handle means fixed to said paddle portion for enabling said paddle to be manipulated;

a ball tethered to said paddle for impacting by said striking surface of the paddle;

a plurality of impact sensing means cooperative with selective surface areas of said striking surface less than the full area of said striking surface to define discrete impact sensing target areas;

means operatively coupled to said impact sensing means for electronically generating a different audible output signal in response to impacting of different ones of said discrete impact sensing target areas such that a different audible output signal is generated each time a different impact sensing target area senses an impact with said ball;

sound transducing means for outputting a different audible sound in response to said different audible output signals; and means operatively coupled to said plurality of impact sensing means for electronically generating and visually displaying a score based on impacts sensed by said discrete impact sensing target areas.

18. The electronic paddle game device of claim 17 wherein said paddle is formed from plastic and said handle means has an integral ribbed surface formed therein.

19. The electronic paddle game device of claim 18 wherein said handle means includes ball storage means defined by an annular rim peripherally of a ball receiving through-hole.

20. The electronic paddle game device of claim 17 wherein said score generating means generates a score based upon a number of impacts sensed by said impact sensing means.

21. The electronic paddle game device of claim 17 wherein said score generating means generates a score based upon the location of the particular impact sensing target area impacted by said ball.

22. The electronic paddle game device of claim 17 further comprising light emitting means for visually indicating that an impact has been sensed by one of said discrete impact sensing target areas.

23. An electronic paddle game device comprising, in combination, a hand-holdable paddle having a generally circular paddle portion defining a substantially rigid striking surface, and handle means secured to said paddle portion for enabling said paddle to be manipulated to impact an object with said striking surface;

a plurality of discrete impact sensors defining a plurality of discrete impact surfaces positioned in a predetermined pattern on said striking surface in substantially coplanar relation with the remainder of said striking surface so as to provide active impact areas and inactive impact areas on said striking surface such that impact of an object with one of said impact surfaces is sensed by at least one of said impact sensors, and impact of said object with said inactive areas is not sensed by said impact sensors; and means operatively coupled to at least one of the plurality of impact sensors for electronically generating and visually displaying a score based on an impact sensed by said at least one impact sensor.

24. An electronic paddle game device comprising, in combination, a paddle having a striking surface and means enabling said paddle to be manipulated to impact an object with said striking surface;

impact sensing means cooperative with said striking surface for sensing impact between said striking surface and said object; and a plurality of light emitting means spaced about the paddle and operatively coupled to said impact sensing means for emitting light when said impact sensing means senses an impact with said object.

25. An electronic paddle game device comprising, in combination, a hand-holdable paddle having a generally circular paddle portion defining a substantially rigid striking surface, and a handle portion secured to said paddle portion for enabling said paddle to be manipulated to impact an object with said striking surface;

electronic impact sensing means within said paddle for sensing an impact between said striking surface and said object;

means operatively coupled to said impact sensing means for electronically generating an output signal when said impact sensing means senses an impact between said striking surface and said object;

display means supported by said paddle for visually displaying a numerical value; and electronic means coupling said impact sensing means to said display means for causing a numerical score value to be displayed in response to generated output signals.

* * * * *